US007192114B2

(12) United States Patent
Suzuki et al.

(10) Patent No.: US 7,192,114 B2
(45) Date of Patent: Mar. 20, 2007

(54) PRINTING APPARATUS AND PRINTING METHOD

(75) Inventors: Yuichiro Suzuki, Kanagawa (JP); Masao Maeda, Kanagawa (JP); Hitoshi Nishikori, Tokyo (JP); Kazuhisa Kuruma, Kanagawa (JP); Hideki Nakanishi, Kanagawa (JP); Takayuki Murata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 279 days.

(21) Appl. No.: 10/943,012

(22) Filed: Sep. 17, 2004

(65) Prior Publication Data

US 2005/0062775 A1 Mar. 24, 2005

(30) Foreign Application Priority Data

Sep. 24, 2003 (JP) ..... 2003-332394

(51) Int. Cl.
*B41J 29/393* (2006.01)
*B41J 29/38* (2006.01)

(52) U.S. Cl. ..... 347/19; 347/9

(58) Field of Classification Search ..... 347/19
See application file for complete search history.

(56) References Cited

U.S. PATENT DOCUMENTS 4,313,124 A 1/1982 Hara
4,345,262 A 8/1982 Shirato et al.
4,463,359 A 7/1984 Ayata et al.
4,723,129 A 2/1988 Endo et al.
4,740,796 A 4/1988 Endo et al.
6,089,695 A 7/2000 Takagi et al.
6,637,853 B1 * 10/2003 Ahne et al. ..... 347/19
2003/0142153 A1 * 7/2003 Nakajima et al. ..... 347/9

FOREIGN PATENT DOCUMENTS

JP 8-25700 1/1996
JP 11-988 1/1999

* cited by examiner

*Primary Examiner*—Manish S. Shah
*Assistant Examiner*—Jannelle M. Lebrón
(74) *Attorney, Agent, or Firm*—Fitzpatrick, Cella, Harper & Scinto

(57) ABSTRACT

A printing apparatus and printing method can realize high-quality printing without degrading the quality of a printed image even when a nozzle restriction function is adopted in addition to a discharge failure complement function. In a printing apparatus using an inkjet printhead having a plurality of nozzles, whether the position of an ink discharge failure nozzle exists at or near the end of a nozzle area which is still usable regardless of the use restriction on the nozzles is detected. The use of a nozzle for complementary printing executed with a nozzle positioned near the ink discharge failure nozzle is controlled in accordance with the detection result.

8 Claims, 10 Drawing Sheets

PRINTING APPARATUS AND PRINTING METHOD

FIELD OF THE INVENTION

This invention relates to a printing apparatus and printing method and, more particularly, to a method of complementary printing for discharge failure in an inkjet printing apparatus.

BACKGROUND OF THE INVENTION

The number of nozzles of a printhead used in an inkjet printer increases year by year. Along with this, the manufacture of the printhead becomes more difficult year by year. The manufacturing yield of the printhead must be increased by decreasing the number of defective printheads having nozzles which fail to discharge ink (to be referred to as discharge failure nozzles hereinafter).

As a method of increasing the manufacturing yield of the printhead, there has conventionally been known complement of discharge failure. According to this technique, printing data which cannot be used for printing owing to a discharge failure nozzle is printed using another nozzle, thereby compensating dots which cannot be printed. This technique is disclosed in, e.g., Japanese Patent Publication Laid Open Nos. 8-025700 and 11-000988.

By using complement of discharge failure, a printhead which is screened as a defective printhead can be employed as a nondefective printhead, and the yield of the printhead can be increased.

In conventional complement of discharge failure, complementary printing is performed using several nozzles (to be referred to as target nozzles hereinafter) arranged on the two sides of a discharge failure nozzle in the nozzle array of a printhead. More specifically, in complementary printing, nozzles near a discharge failure nozzle discharge ink by using printing data which should be originally printed by the discharge failure nozzle. The printing duty is controlled to make less conspicuous a white stripe which appears on a printing medium owing to an ink discharge failure.

The inkjet printer conventionally has a nozzle restriction function. The nozzle restriction function restricts the number of available nozzles of the printhead to reduce the printing data amount. As a result, the capacity of a memory used to store printing data, and the data transfer amount from the memory to the printhead can advantageously be reduced.

In the use of both the discharge failure complement function and nozzle restriction function, however, if a discharge failure nozzle is created near the boundary between an area where the use of the nozzles of the nozzle array of the printhead are restricted and an area where the nozzles are free from any restriction, a target nozzle used for complement of discharge failure may fall within the area where the use of the nozzles are restricted. In this case, complementary printing for discharge failure by using a target nozzle cannot help printing in an area where printing should not be originally done. As a result, the quality of a printed image degrades.

SUMMARY OF THE INVENTION

Accordingly, the present invention is conceived as a response to the above-described disadvantages of the conventional art.

For example, an apparatus and method according to the present invention is capable of realizing high-quality printing without degrading the quality of a printed image even when the nozzle restriction function of restricting nozzles for use is adopted in complement of discharge failure by using a target nozzle.

According to one aspect of the present invention, preferably, there is provided a printing apparatus having a function capable of restricting use of some of a plurality of nozzles in actual printing operation when printing is performed using an inkjet printhead having the plurality of nozzles, comprising: first storage means for storing a position of an ink discharge failure nozzle among the plurality of nozzles; detection means for detecting whether the position of the ink discharge failure nozzle stored in the first storage means exists at or near an end of a nozzle area which is still usable regardless of use restriction on the plurality of nozzles; complementary printing means for performing, by using a nozzle positioned near the ink discharge failure nozzle, complementary printing in an area where printing is impossible due to the ink discharge failure nozzle; and complementary printing control means for controlling use of the nozzle for complementary printing by the complementary printing means in accordance with a detection result of the detection means.

Desirably, the plurality of nozzles are divided into a plurality of blocks and the use of some of the plurality of nozzles is restricted for each block. In this case, the printing apparatus desirably further comprises second storage means for storing information which defines an area where the use of some of the plurality of nozzles is restricted.

The detection means desirably detects whether the position of the ink discharge failure nozzle falls within a block corresponding to the end of the nozzle area which is still usable regardless of the use restriction on some of the plurality of nozzles. When the position of the ink discharge failure nozzle is detected to fall within the block corresponding to the end of the usable nozzle area, the detection means desirably further detects whether the position of the ink discharge failure nozzle is near a boundary between the block and a block which becomes unusable owing to the use restriction on some of the plurality of nozzles.

The complementary printing control means preferably controls not to set, as a nozzle used for complementary printing by the complementary printing means in accordance with the detection result, a nozzle belonging to the block which becomes unusable owing to the use restriction on some of the plurality of nozzles.

The inkjet printhead may comprise a plurality of nozzle arrays, each consisting of a plurality of nozzles. In this case, the printing apparatus may comprise a plurality of first storage means in correspondence with the plurality of nozzle arrays. The printing apparatus preferably further comprises switching means for switching the use of the plurality of first storage means in accordance with a nozzle array for use among the plurality of nozzle arrays.

The inkjet printhead desirably comprises an electrothermal transducer which generates thermal energy to be applied to ink in order to discharge ink by using thermal energy.

According to another aspect of the present invention, preferably, there is provided a printing method for a printing apparatus which uses an ink-jet printhead with a plurality of nozzles and has a function capable of restricting use of some of the plurality of nozzles in actual printing operation, comprising: a storage step of storing in a register a position of an ink discharge failure nozzle among the plurality of nozzles; a detection step of detecting whether the position of the ink discharge failure nozzle stored in the register at the storage step exists at or near an end of a nozzle area which is still usable regardless of use restriction on the plurality of nozzles; a complementary printing step of performing, by using a nozzle positioned near the ink discharge failure nozzle, complementary printing in an area where printing is impossible due to the ink discharge failure nozzle; and a complementary printing control step of controlling use of the nozzle for complementary printing at the complementary printing step in accordance with a detection result at the detection step.

In accordance with the present invention as described above, whether or not the position of an ink discharge failure nozzle exists at or near the end of a nozzle area which is usable regardless of the use restriction on the nozzles is detected. The use of a nozzle for complementary printing executed with a nozzle positioned near the ink discharge failure nozzle is controlled in accordance with the detection result.

The invention is particularly advantageous since, when some of nozzles become ones which should not be originally used for printing owing to the use restriction on some of a plurality of nozzles, complementary printing using such nozzle is controlled not to be performed. Even when both complementary printing and the nozzle restriction function of restricting a nozzle for use are employed, high-quality printing can be realized without degrading the quality of a printed image.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

<Description of Inkjet Printing Apparatus (FIG. 1)>

Figure 1:
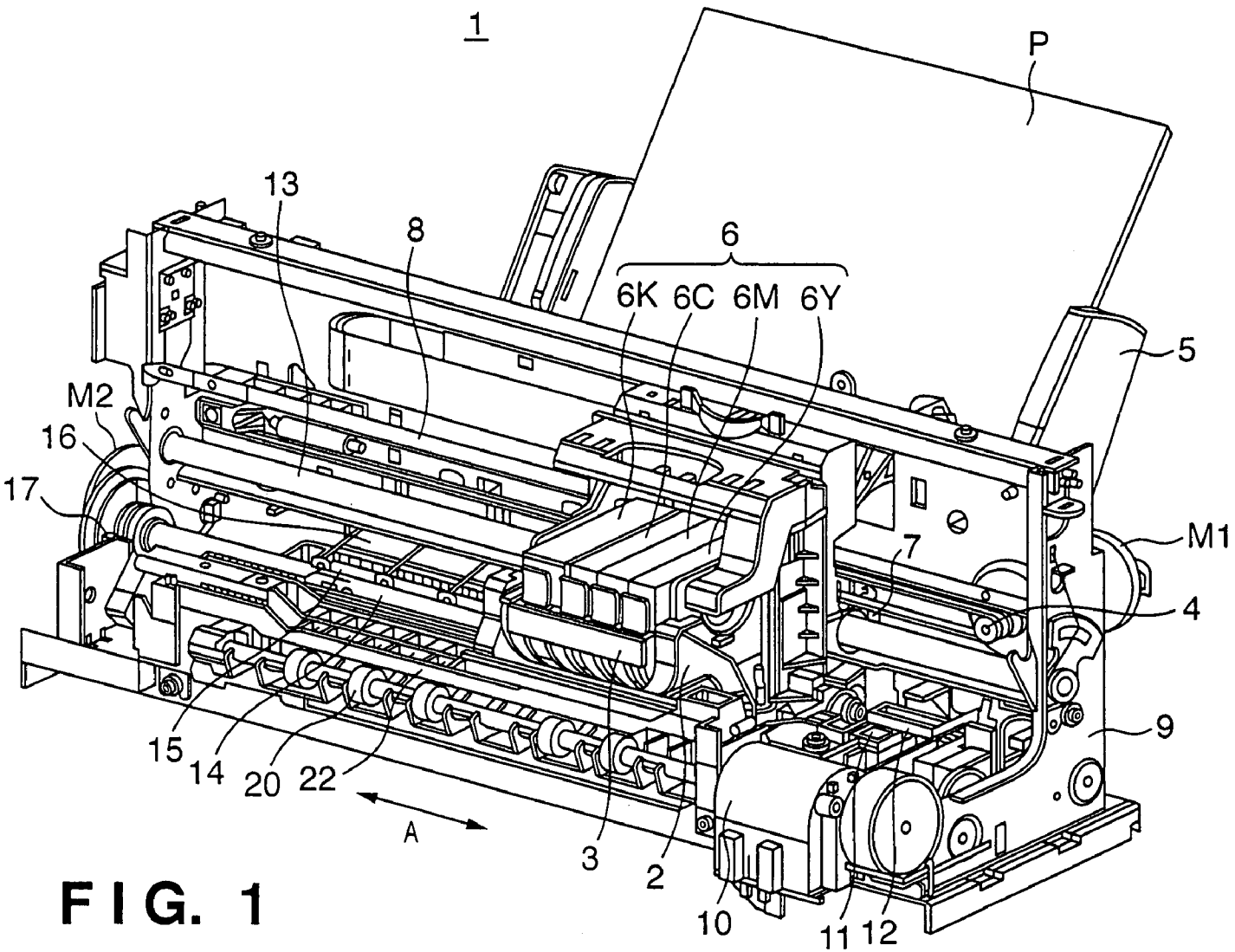
FIG. 1 is an outer perspective view showing the schematic arrangement of an inkjet printing apparatus.

FIG. 1 is a perspective view showing an external appearance of the configuration of an inkjet printing apparatus 1 which is a typical embodiment of the present invention.

The inkjet printing apparatus 1 (hereinafter referred to as the printer) shown in FIG. 1 performs printing in the following manner. Driving force generated by a carriage motor M1 is transmitted from a transmission mechanism 4 to a carriage 2 incorporating a printhead 3, which performs printing by discharging ink in accordance with an inkjet method, and the carriage 2 is reciprocally moved in the direction of arrow A. A printing medium P. e.g., printing paper, is fed by a paper feeding mechanism 5 to be conveyed to a printing position, and ink is discharged by the printhead 3 at the printing position of the printing medium P, thereby realizing printing.

To maintain an excellent state of the printhead 3, the carriage 2 is moved to the position of a recovery device 10, and discharge recovery processing of the printhead 3 is intermittently performed.

In the carriage 2 of the printer 1, not only the printhead 3 is mounted, but also an ink cartridge 6 reserving ink to be supplied to the printhead 3 is mounted. The ink cartridge 6 is attachable/detachable to/from the carriage 2. Note that numeral 6 is used for collectively referring to four independent ink cartridges described later.

The printer 1 shown in FIG. 1 is capable of color printing. Therefore, the carriage 2 holds four ink cartridges respectively containing magenta (M), cyan (C), yellow (Y), and black (K) inks. These four cartridges are independently attachable/detachable.

Appropriate contact between the junction surfaces of the carriage 2 and the printhead 3 can achieve necessary electrical connection. By applying energy to the printhead 3 in accordance with a printing signal, the printhead 3 selectively discharges ink from plural discharge orifices, thereby performing printing. In particular, the printhead 3 according to this embodiment adopts an inkjet method which discharges ink by utilizing heat energy, and comprises electrothermal transducers for generating heat energy. Electric energy applied to the electrothermal transducers is converted to heat energy, which is then applied to ink, thereby creating film boiling. This film boiling causes growth and shrinkage of a bubble in the ink, and generates a pressure change. By utilizing the pressure change, ink is discharged from the discharge orifices. The electrothermal transducer is provided in correspondence with each discharge orifice. By applying a pulsed voltage to the corresponding electrothermal transducer in accordance with a printing signal, ink is discharged from the corresponding discharge orifice.

As shown in FIG. 1, the carriage 2 is connected to a part of a driving belt 7 of the transmission mechanism 4 which transmits driving force of the carriage motor M1, and is slidably supported along a guide shaft 13 in the direction of arrow A. Therefore, the carriage 2 reciprocally moves along the guide shaft 13 in accordance with normal rotation and reverse rotation of the carriage motor M1. In parallel with the moving direction of the carriage 2 (direction of arrow A), a scale 8 is provided to indicate an absolute position of the carriage 2. In this embodiment, the scale 8 is a transparent PET film on which black bars are printed in necessary pitches. One end of the scale 8 is fixed to a chassis 9, and the other end is supported by a leaf spring (not shown).

In the printer 1, a platen (not shown) is provided opposite to the discharge orifice surface where discharge orifices (not shown) of the printhead 3 are formed. As the carriage 2 incorporating the printhead 3 is reciprocally moved by the driving force of the carriage motor M1, a printing signal is supplied to the printhead 3 to discharge ink, and printing is performed on the entire width of the printing medium P conveyed on the platen.

Furthermore, in FIG. 1, numeral 14 denotes a conveyance roller driven by a conveyance motor M2 for conveying the printing medium P. Numeral 15 denotes a pinch roller that presses the printing medium P against the conveyance roller 14 by a spring (not shown). Numeral 16 denotes a pinch roller holder which rotatably supports the pinch roller 15. Numeral 17 denotes a conveyance roller gear fixed to one end of the conveyance roller 14. The conveyance roller 14 is driven by rotation of the conveyance motor M2 transmitted to the conveyance roller gear 17 through an intermediate gear (not shown).

Numeral 20 denotes a discharge roller for discharging the printing medium P, where an image is formed by the printhead 3, outside the printer. The discharge roller 20 is driven by receiving rotation of the conveyance motor M2. Note that the discharge roller 20 presses the printing medium P by a spur roller (not shown) that presses the printing medium by a spring. Numeral 22 denotes a spur holder which rotatably supports the spur roller.

Furthermore, the printer 1 includes the recovery device 10 for recovering discharge failure of the printhead 3, which is arranged at a desired position (e.g., a position corresponding to the home position) outside the reciprocal movement range for printing operation (outside the printing area) of the carriage 2 that incorporates the printhead 3.

The recovery device 10 comprises a capping mechanism 11 for capping the discharge orifice surface of the printhead 3, and a wiping mechanism 12 for cleaning the discharge orifice surface of the printhead 3. In conjunction with the capping operation of the capping mechanism 11, suction means (suction pump or the like) of the recovery device enforces ink discharge from the discharge orifices, thereby executing discharge recovery operation, that is, removing high-viscosity ink and bubbles in the ink channel of the printhead 3.

In addition, when printing operation is not performed, the discharge orifice surface of the printhead 3 is capped by the capping mechanism 11 for protecting the printhead 3 and preventing ink from evaporation and drying. The wiping mechanism 12 is arranged in the neighborhood of the capping mechanism 11 for wiping off an ink droplet attached to the discharge orifice surface of the printhead 3.

By virtue of the capping mechanism 11 and wiping mechanism 12, a normal ink discharge condition of the printhead 3 can be maintained.

<Control Arrangement of Inkjet Printing Apparatus (FIG. 2)>

Figure 2:
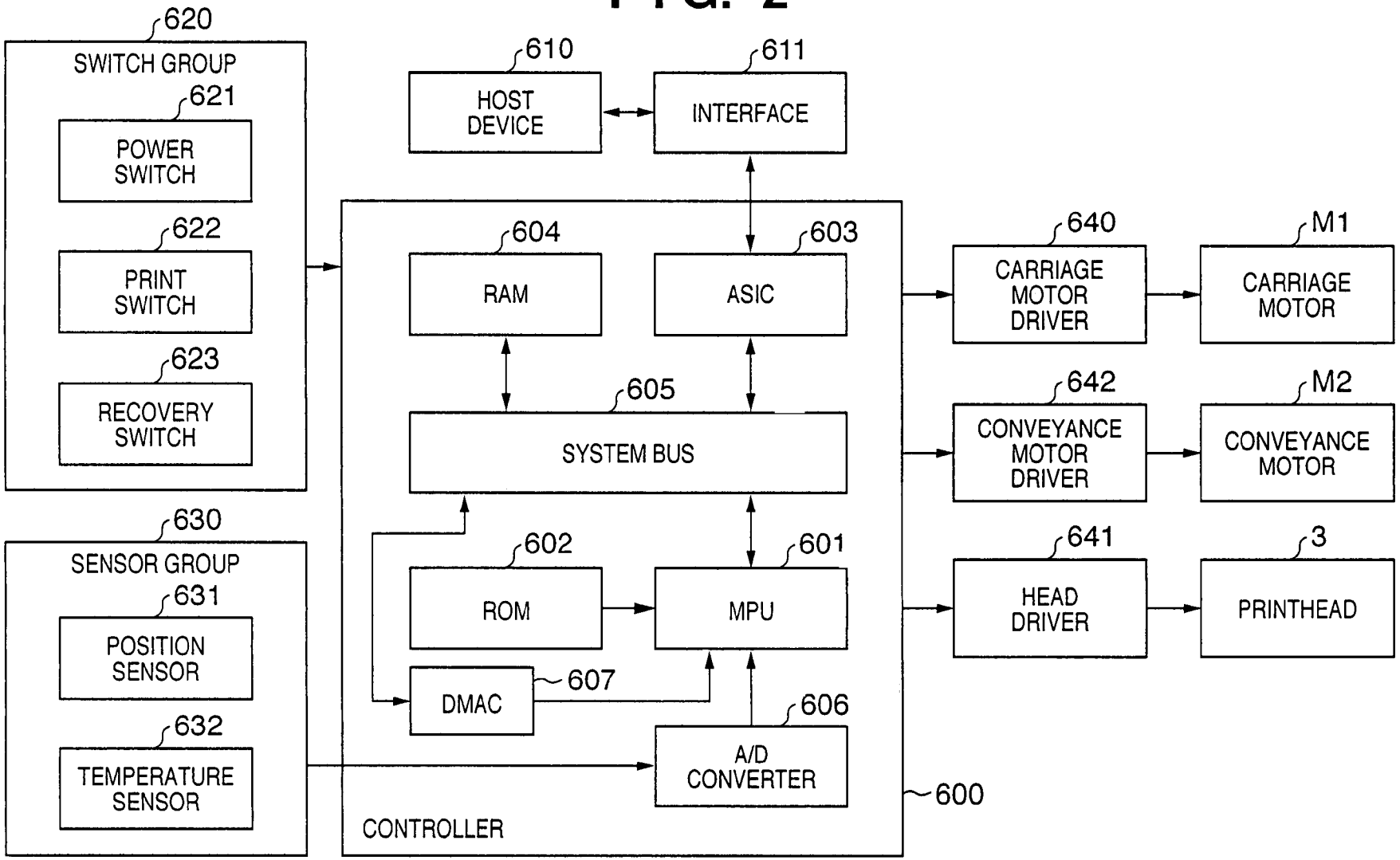
FIG. 2 is a block diagram showing the control configuration of the printing apparatus shown in FIG. 1.

FIG. 2 is a block diagram showing a control structure of the printer shown in FIG. 1.

Referring to FIG. 2, a controller 600 comprises: an MPU 601; ROM 602 storing a program corresponding to the control sequence which will be described later, predetermined tables, and other fixed data; an Application Specific Integrated Circuit (ASIC) 603 generating control signals for controlling the carriage motor M1, conveyance motor M2, and printhead 3; RAM 604 providing an image data developing area or a working area for executing a program; a system bus 605 for mutually connecting the MPU 601, ASIC 603, and RAM 604 for data transmission and reception; and an A/D converter 606 performing A/D conversion on an analog signal inputted by sensors which will be described later and supplying a digital signal to the MPU 601.

Note that numeral 607 in FIG. 2 denotes a DMA controller (DMAC) which performs high speed data input/output to/from a memory and high speed memory access. Further, numeral 610 denotes a computer serving as an image data supplying source (or an image reader, digital camera or the like), which is generically referred to as a host unit. Between the host unit 610 and printer 1, image data, commands, status signals and so forth are transmitted or received via an interface (I/F) 611.

Numeral 620 denotes switches for receiving commands from an operator, which includes a power switch 621, a print switch 622 for designating a print start, and a recovery switch 623 for designating a start of the processing (recovery processing) aimed to maintain an excellent ink discharge state of the printhead 3. Numeral 630 denotes sensors for detecting an apparatus state, which includes a position sensor 631 such as a photo-coupler for detecting a home position h, and a temperature sensor 632 provided at an appropriate position of the printer for detecting an environmental temperature.

Numeral 640 denotes a carriage motor driver which drives the carriage motor M1 for reciprocally scanning the carriage 2 in the direction of arrow A. Numeral 641 denotes a head driver which inputs data and a control signal from the controller 600 and drives the printhead 3. Numeral 642 denotes a conveyance motor driver which drives the conveyance motor M2 for conveying the printing medium P.

When the printhead 3 is scanned for printing, the ASIC 603 transfers driving data (DATA) of the printing element (discharge heater) to the printhead 3 while directly accessing the storage area of the RAM 602.

<Nozzle Arrangement of Printhead (FIG. 3)>

Figure 3:
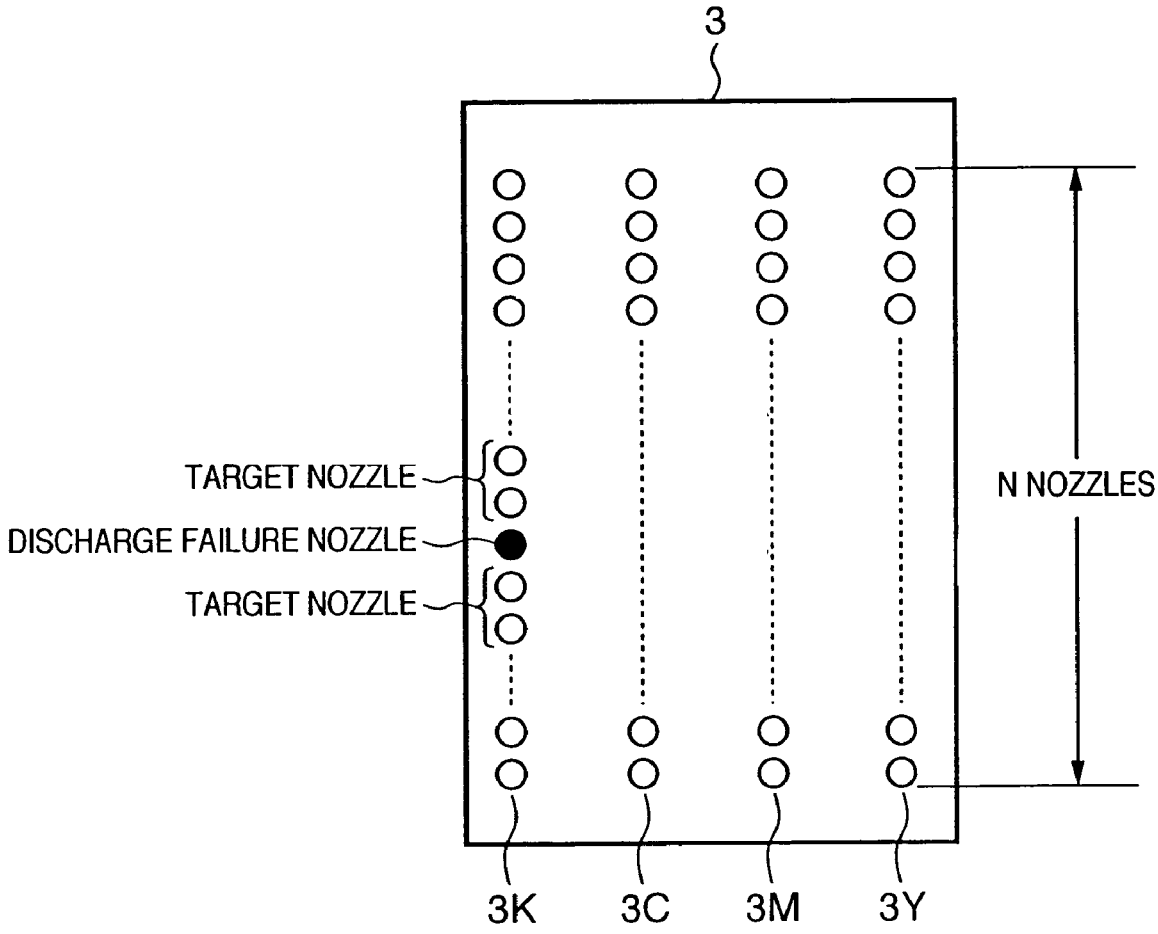
FIG. 3 is a view showing the ink discharge surface of the nozzle array of a printhead 3.

FIG. 3 is a view showing the ink discharge surface of the nozzle array of the printhead 3.

As shown in FIG. 3, the printhead 3 has four nozzle arrays corresponding to four color inks, yellow (Y), magenta (M), cyan (C), and black (K) inks, that is, a nozzle array 3Y for discharging Y ink, a nozzle array 3M for discharging M ink, a nozzle array 3C for discharging C ink, and a nozzle array 3K for discharging K ink. Each nozzle array is formed from N nozzles.

In the example shown in FIG. 3, the embodiment performs complementary printing for discharge failure by using two nozzles on each of both sides of a discharge failure nozzle, i.e., a total of four nozzles as target nozzles.

<Complementary Printing for Discharge Failure (FIGS. 4 to 10)>

Complementary printing for discharge failure by using the printing apparatus and printhead with the above arrangements will be explained. Complementary printing for discharge failure is executed in association with the MPU 601, ASIC 603, RAM 604, DMAC 607, and head driver 641.

Figure 4:
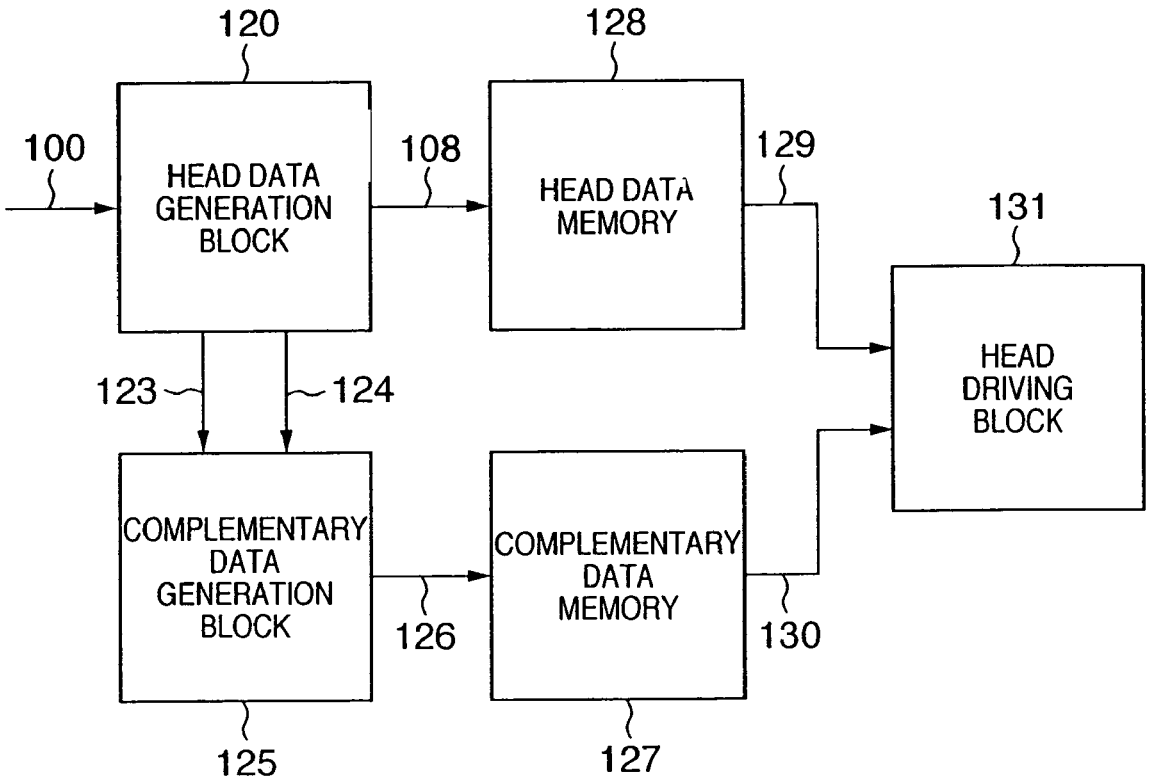
FIG. 4 is a block diagram showing a function processing block which executes complementary printing for discharge failure.

FIG. 4 is a block diagram showing a function processing block which executes complementary printing for discharge failure.

In FIG. 4, a head generation block 120 which has received printing data 100 via the interface 611 from the host apparatus 600 such as a personal computer (PC) or digital camera outputs target data 123 and target nozzle designation data 124 to a complementary data generation block 125, and DMA block write data 108 to a head data memory 128 serving as an area assigned to the RAM 604.

The target data 123 is 4-bit data obtained by extracting printing data used to print from two nozzles on each of both sides of a discharge failure nozzle. The target nozzle designation data 124 specifies which of the four bits of the target data 123 is a bit settable as a target. The target nozzle designation data 124 is also formed from 4-bit data. The DMA block write data 108 is stored in the head data memory 128.

The discharge failure complementary data generation block 125 performs complementary processing for the input target data 123 by using a bit corresponding to printing data for which no ink is discharged. At this time, the discharge failure complementary data generation block 125 controls not to perform complementary printing except that a nozzle set as a target is used by referring to information of the target nozzle designation data 124. When a plurality of target nozzles exist, which of the nozzles is used for complementary printing is determined as follows. For example, priorities are assigned to four target nozzles, and whether or not printing data exists is checked from target nozzles having higher priorities. Complementary printing is performed using the first detected bit (nozzle) corresponding to printing data for which no ink is discharged.

The discharge failure complementary data generation block 125 which performs complementary processing for the target data 123 stores discharge failure-complemented data 126 into a complementary data memory 127.

A head driving block 131 reads out head data 129 from the head data memory 128 and discharge failure-complemented data 130 from the complementary data memory 127. The head driving block 131 replaces, with the discharge failure-complemented data 130, data of the head data 129 that correspond to two nozzles on each of both sides of a discharge failure nozzle, generating data to be finally transferred to the printhead 3. The head driving block 131 transfers the final data to the printhead 3 to execute actual printing operation.

The overall flow of complementary printing for discharge failure has been described.

The main point of the embodiment is to generate the target data 123 and target nozzle designation data 124. This will be explained in detail below.

Processing of generating the target data 123 and target nozzle designation data 124 will be explained with reference to FIG. 5.

Figure 5:
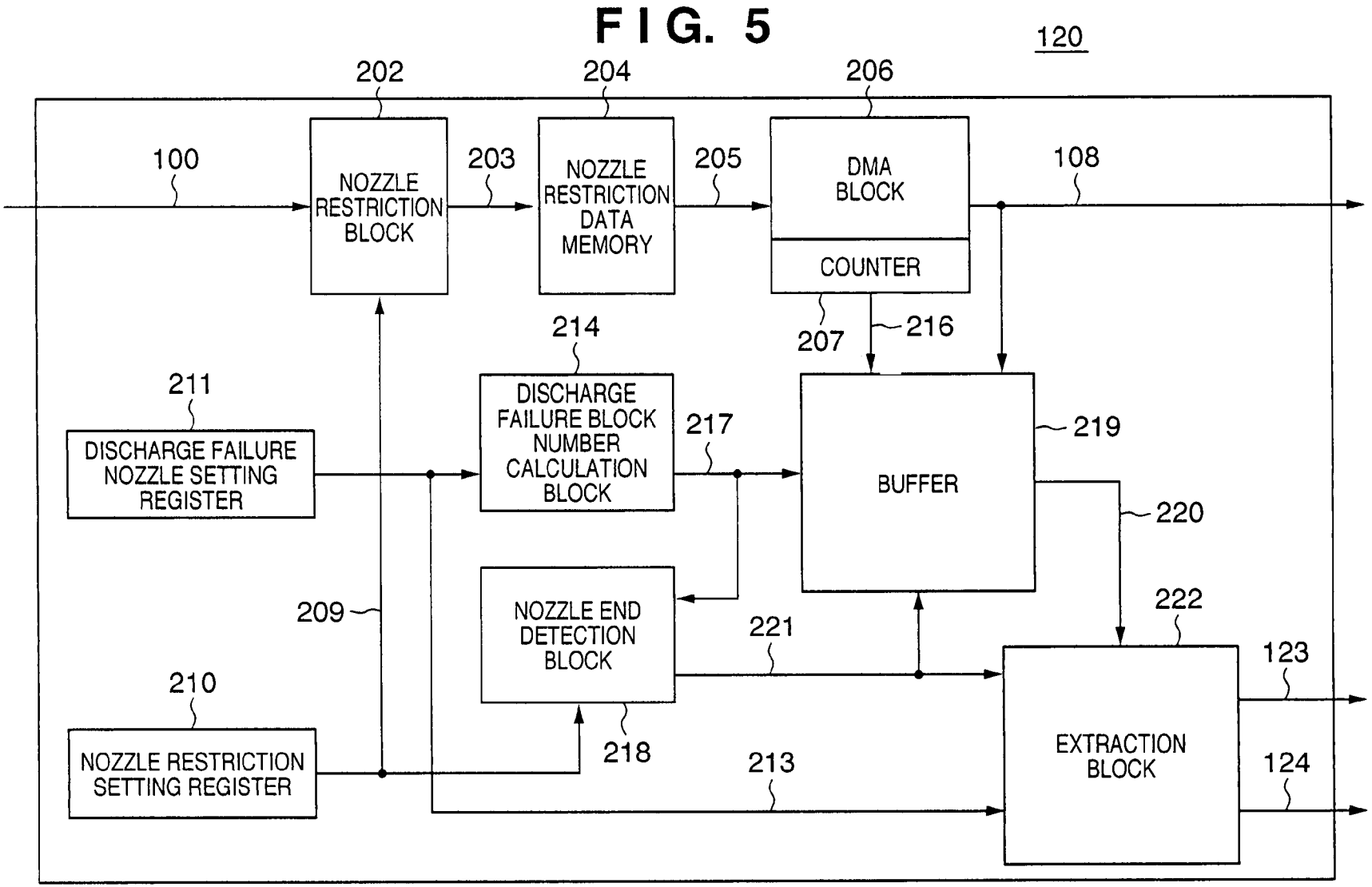
FIG. 5 is a block diagram showing the detailed function configuration of a head data generation block 120.

FIG. 5 is a block diagram showing the detailed function configuration of the head data generation block 120.

In FIG. 5, reference numeral 202 denotes a nozzle restriction block which performs raster-column conversion for the input printing data 100 serving as raster data so that the data 100 corresponds to the nozzle array of the printhead. Also, the nozzle restriction block 202 loads nozzle restriction data 209 set in a nozzle restriction setting register 210, and decides, in accordance with the value of the data, as to which part of the nozzle array of the printhead is used to print raster-column converted printing data. The nozzle restriction block 202 generates nozzle-restricted printing data 203, and writes it in a nozzle restriction data memory 204. At this time, the nozzle restriction data 209 is input from the nozzle restriction setting register 210. In the embodiment, nozzles are restricted for each block. The definition of the block will be described later.

Reference numeral 206 denotes a DMA block which reads out DMA block read data 205 from the nozzle restriction data memory 204, and writes the DMA block write data 108 into the head data memory 128.

Figure 6:
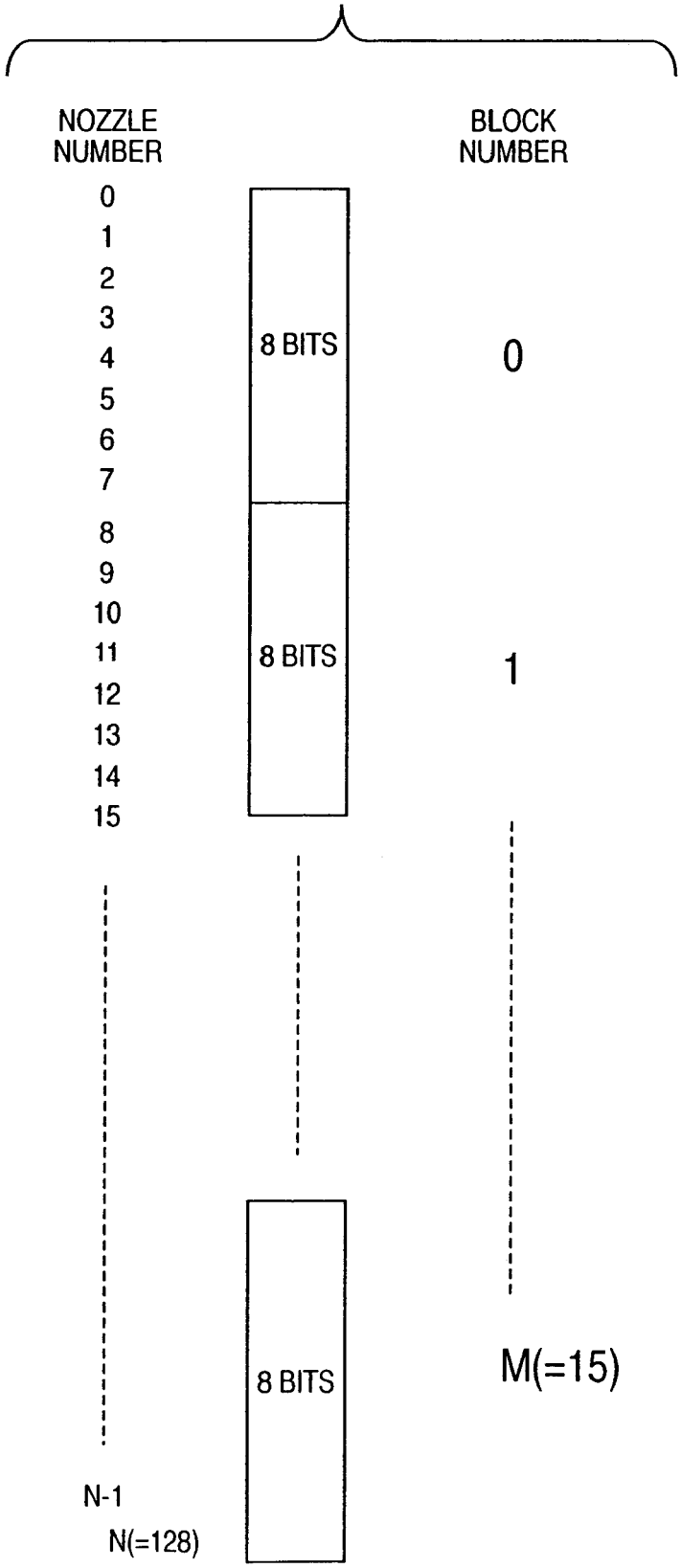
FIG. 6 is a view showing details of DMA transfer.

FIG. 6 is a view showing details of DMA transfer.

In the example shown in FIG. 6, the number of nozzles of one nozzle array is 128, i.e., N=128, and 1-bit printing data corresponds to one nozzle. Printing data (128 bits) for one nozzle array of the printhead is processed as 16 blocks each of eight bits, and the blocks are assigned block numbers (M: 0 to 15). Each block serves as a nozzle restriction unit. The nozzles are also assigned nozzle numbers (N: 0 to 127).

The bit widths of the DMA block read data 205 and DMA block write data 108 are eight bits, and data transfer of one nozzle array is completed by M (=N/8) DMA transfer operations. In the example of FIG. 6, data transfer of one nozzle array is completed by 16 (=128/8) DMA transfer operations.

The DMA block 206 comprises a DMA counter 207 which counts the number of DMA transfer operations. The DMA counter 207 outputs the count value as DMA count data 216 to a target data buffering block (to be referred to as a buffer hereinafter) 219.

As shown in FIG. 6, a nozzle number in a discharge failure state among nozzles assigned nozzle numbers (N: 0 to 127) is set in a discharge failure nozzle setting register 211. A discharge failure block number calculation block 214 reads out a discharge failure nozzle number 213 set in the discharge failure nozzle setting register 211, calculates the block number of a block containing the discharge failure nozzle, and outputs the result as a discharge failure block number 217 to the buffer 219.

Figure 7:
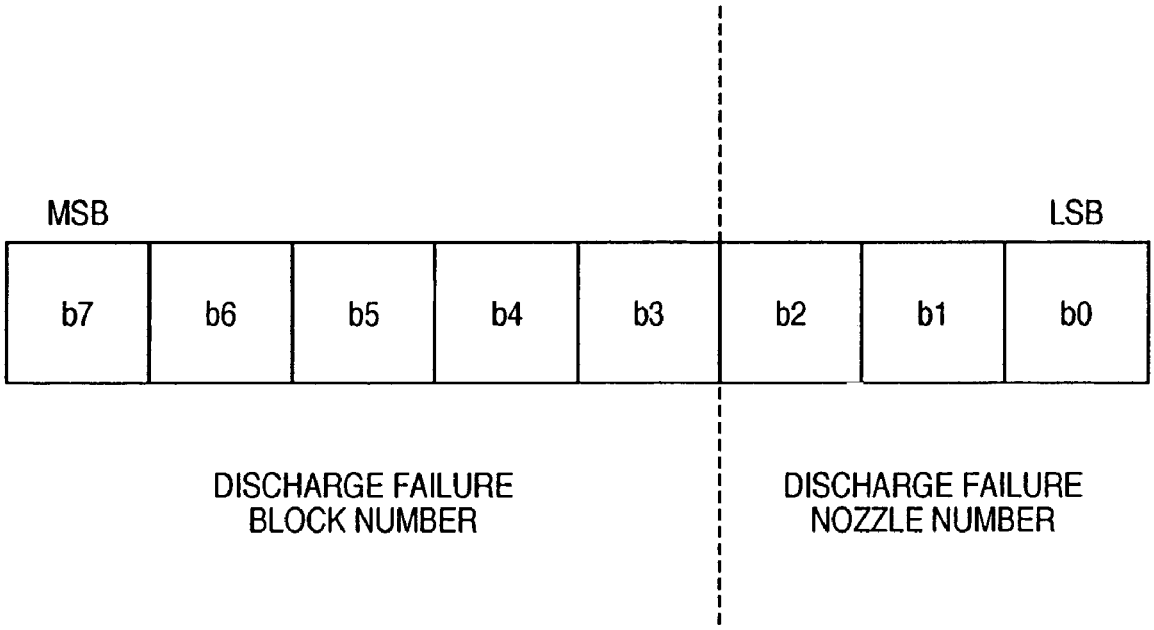
FIG. 7 is a view showing the bit configuration of data representing a discharge failure nozzle number 213.

FIG. 7 is a view showing a bit configuration of data representing the discharge failure nozzle number 213.

In the example shown in FIG. 6, eight nozzles exist in each block, and thus 3-bit data suffices to specify a nozzle position in each block. When the discharge failure nozzle number 213 is divided at the boundary between bit 2 (b2) and bit 3 (b3), as shown in FIG. 7, upper bits (b7 (MSB) to b3) represent a block number containing a discharge failure nozzle, and lower three bits (b2 to b0 (LSB)) represent the position of the discharge failure nozzle in the block.

The discharge failure block number calculation block 214 extracts upper five bits from the discharge failure nozzle number 213, and outputs these bits as the discharge failure block number 217.

A nozzle end detection block 218 detects, from the nozzle restriction data 209 and discharge failure block number 217, whether a block containing a discharge failure nozzle exists at one end or the other end of nozzle restriction-free blocks, and outputs nozzle end block data 221 as the result.

Detection operation will be explained in more detail.

Figure 8:
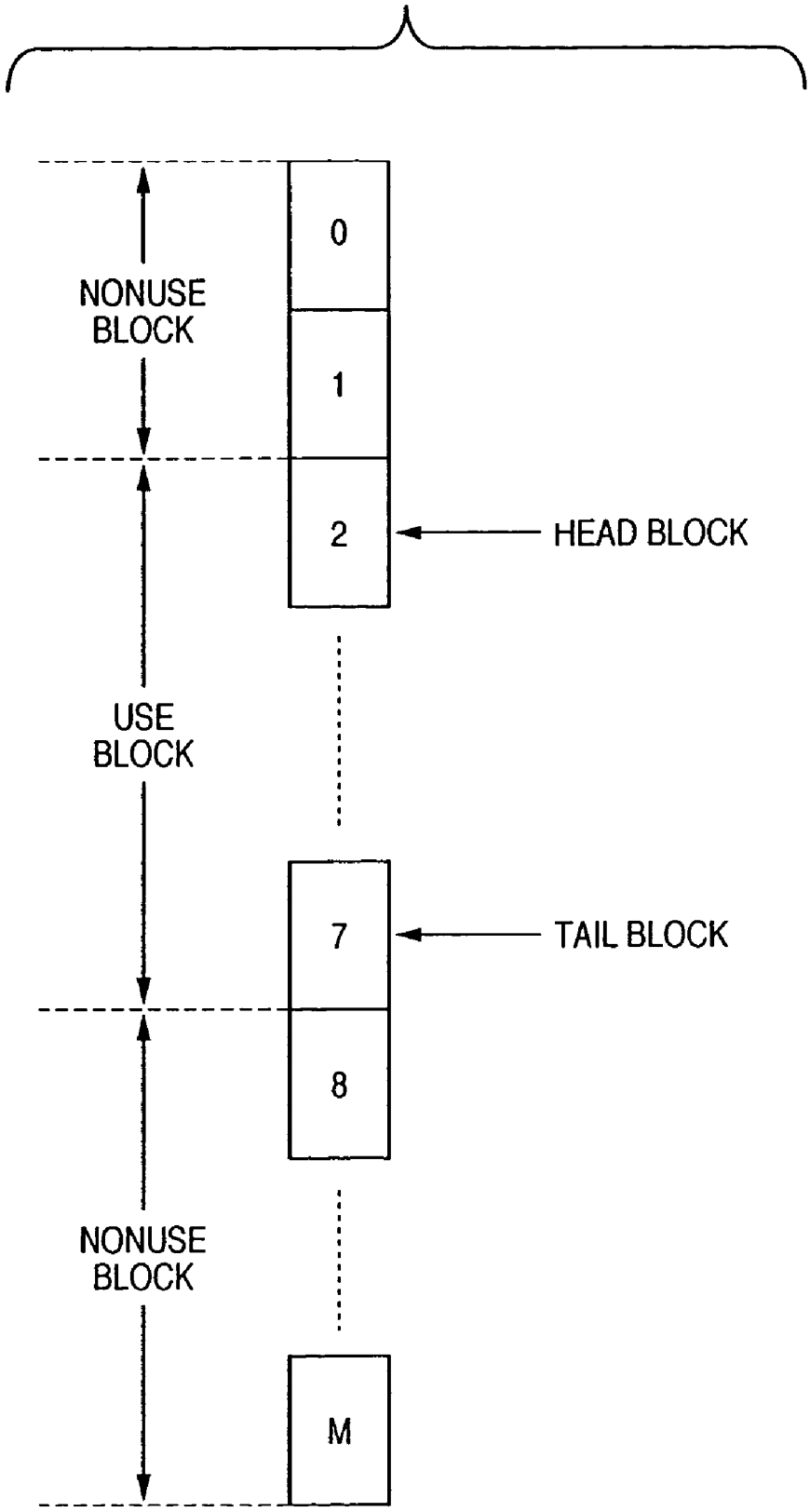
FIG. 8 is a view showing a state in which whether a block containing a discharge failure nozzle exists at one end or the other end of nozzle restriction-free blocks is detected.

FIG. 8 is a view showing a state in which whether a block containing a discharge failure nozzle exists at one end (head block) or the other end (tail block) of nozzle restriction-free blocks is detected.

In the embodiment, as described above, nozzles are restricted for each block. For example, when block 2 to block 7 are set as use blocks, blocks 0, 1, and 8 to M (=15) are subjected to the nozzle restriction. A block having a smaller block number will be called a head block, and a block at an opposite end will be called a tail block. In the example of FIG. 8, block 2 is a head block, and block 7 is a tail block.

The buffer 219 basically compares the value (DMAV) of the DMA count data 216 with the value (DFN) of the discharge failure block number 217, and fetches three data where DMAV−DFN="−1", DMAV−DFN="0", and DMAV−DFN="+1" hold. The buffer 219 outputs the data as buffered data 220 to a target data extraction block (to be referred to as an extraction block hereinafter) 222. That is, the extraction block 222 receives data of a discharge failure block and the preceding and succeeding blocks, i.e., 8×3=24-bit data.

Note that the buffer 219 has the following two exceptional operations when a discharge failure block is a head or tail block.

When the discharge failure block is a head block, no block having DMAV−DFN="−1" exists. When the discharge failure block is a tail block, no block having DMAV−DFN="+1" exists. Hence, if the value of the nozzle end block data 221 represents the head block, "0" is written into the buffer 219 without fetching data where DMAV−DFN="−1" holds. Similarly, if the value of the nozzle end block data 221 represents the tail block, "0" is written into the buffer 219 without fetching data where DMAV−DFN="+1" holds.

The extraction block 222 extracts four bits serving as target bits from 24 bits of the buffered data 220, and outputs the extracted bits as the target data 123. By using the nozzle end block data 221, the extraction block 222 generates the target nozzle designation data 124 representing which of four nozzles corresponding to the target data 123 can be used as a target nozzle.

Operation of extracting a target bit will be explained in more detail.

Figure 9:
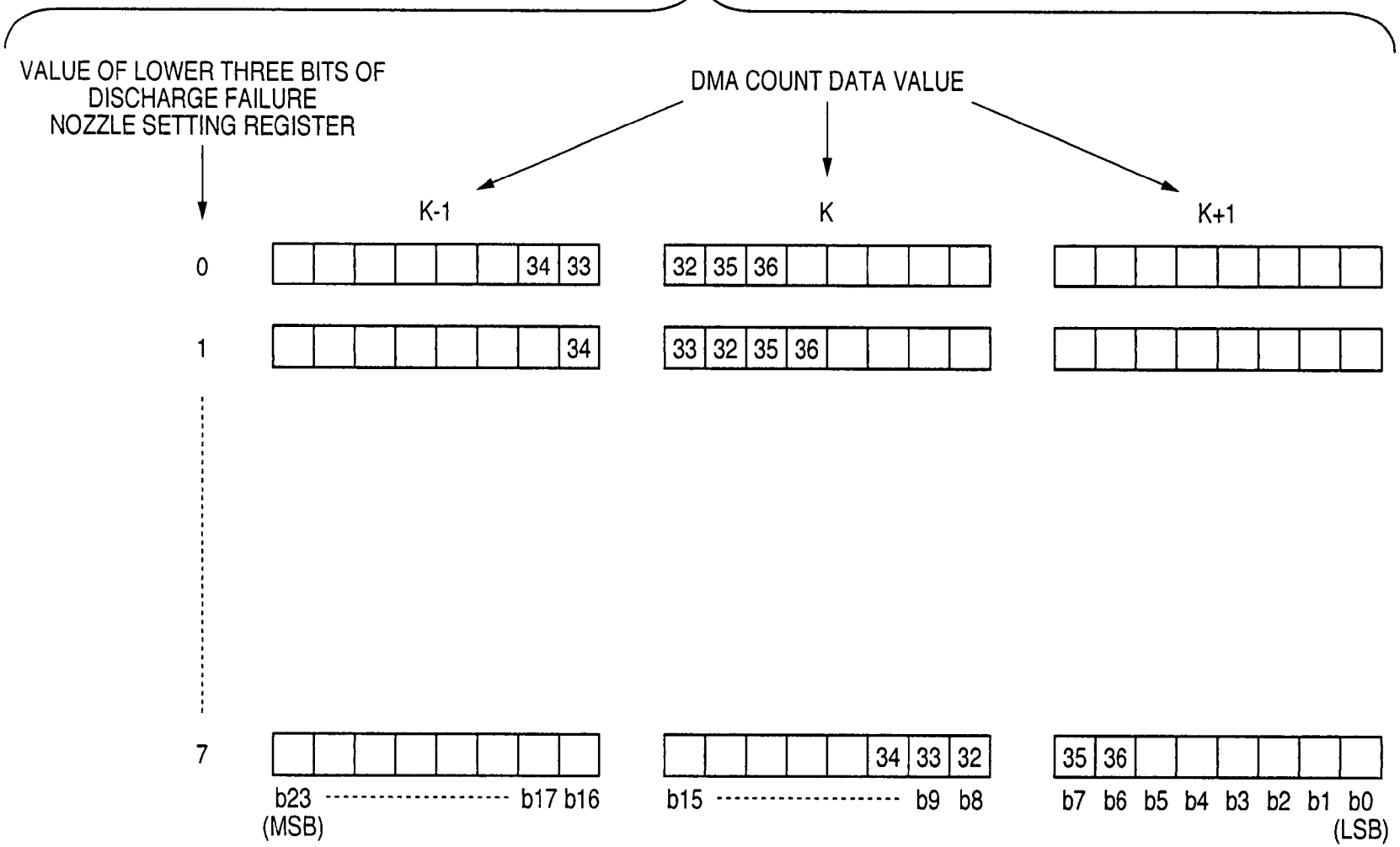
FIG. 9 is a view showing the relationship between DMA count data and data fetch.

FIG. 9 is a view showing the relationship between DMA count data and data fetch.

Note that 24 "□"s shown in FIG. 9 represent 24-bit buffered data 220 which is temporarily stored in the extraction block 222, and each "□" corresponds to 1-bit data. In FIG. 9, bits are called b0 (LSB), b1, . . . , b23 (MSB) from right to left.

FIG. 9 shows a state in which 8-bit data is fetched where the DMA count data 216 is "K−1", "K", and "K+1" for a value "K" of the discharge failure block number 217.

As shown in FIG. 9, the position of a discharge failure nozzle 32 can be determined in accordance with the value of lower three bits of data representing the discharge failure nozzle number 213. In this case, data to be printed by two nozzles 33 and 34, and two nozzles 35 and 36 which are respectively located on both sides of the discharge failure nozzle 32 serve as the target data 123. For example, when the value of lower three bits of the discharge failure nozzle number 213 is "1", bit 16, bit 15, bit 13, and bit 12 of the buffered data 220 serve as the target data 123.

Generation of the target nozzle designation data 124 will be described in more detail.

Figure 10A:
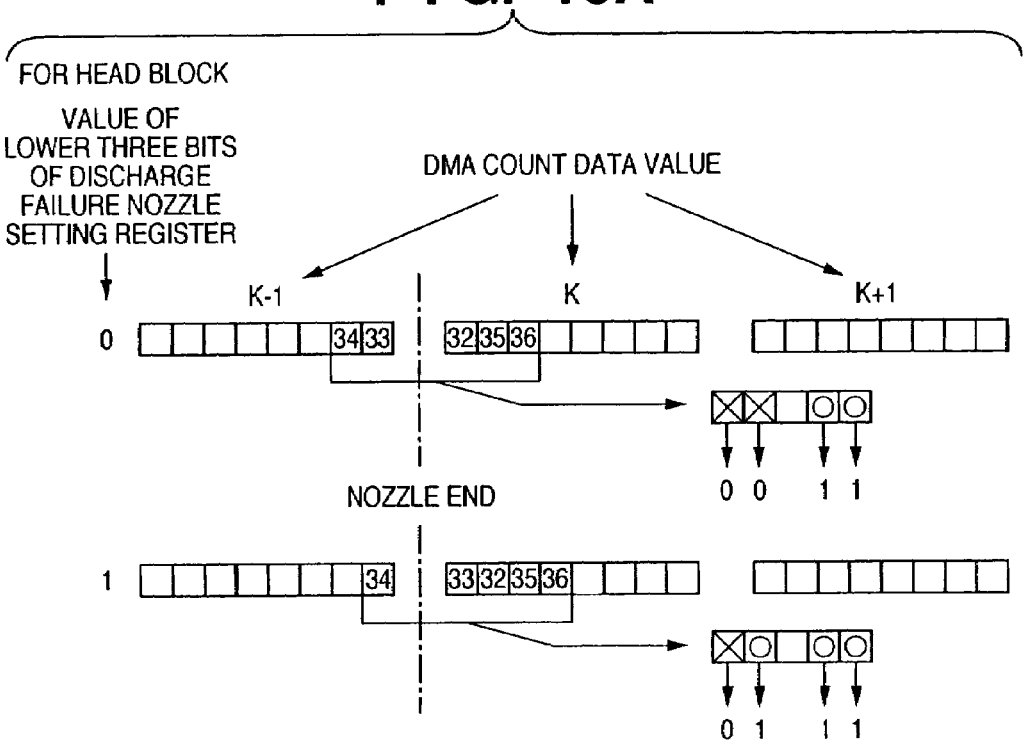
FIGS. 10A and 10B are views showing generation of target nozzle designation data.
Figure 10B:
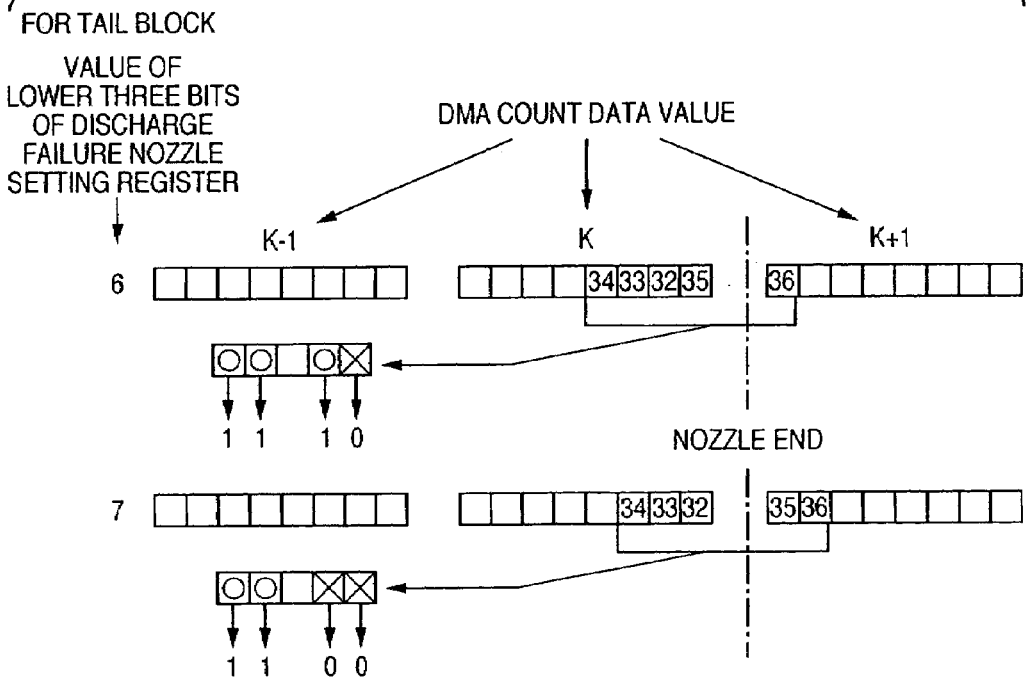

FIGS. 10A and 10B are views showing generation of the target nozzle designation data.

In the embodiment, "1" represents a target nozzle, and "0" represents a non-target nozzle. All the bits of the target nozzle designation data 124 are "0"s when no discharge failure nozzle exists in a head or tail block.

In a case where a discharge failure nozzle exists in at least either a head or tail block, non-target nozzles are generated in four cases as shown in FIGS. 10A and 10B.

These cases will be sequentially explained. When a discharge failure nozzle exists in a head block and the value of lower three bits of the discharge failure nozzle number 213 is "0", the discharge failure nozzle 32 is positioned as shown in the upper part of FIG. 10A. In this case, the nozzle end exists between the discharge failure nozzle 32 and the target nozzle 33, and complementary printing using the target nozzles 33 and 34 is not possible. Hence, the values of four bits of the target nozzle designation data 124 become "0011".

Similarly, when the value of lower three bits of the discharge failure nozzle number 213 is "1", the discharge failure nozzle 32 is positioned as shown in the lower part of FIG. 10A. In this case, the nozzle end exists between the target nozzles 33 and 34, and complementary printing using the target nozzle 34 is not possible. Thus, the values of four bits of the target nozzle designation data 124 become "0111".

When a discharge failure nozzle exists in a tail block and the value of lower three bits of the discharge failure nozzle number 213 is "6", the discharge failure nozzle 32 is positioned as shown in the upper part of FIG. 10B. In this case, the nozzle end exists between the target nozzles 35 and 36, and complementary printing using the target nozzle 36 is not possible. Thus, the values of four bits of the target nozzle designation data 124 become "1110".

Similarly, when the value of lower three bits of the discharge failure nozzle number 213 is "7", the discharge failure nozzle 32 is positioned as shown in the lower part of FIG. 10B. In this case, the nozzle end exists between the discharge failure nozzle 32 and the target nozzle 35, and complementary printing using the target nozzles 35 and 36 is not possible. Thus, the values of four bits of the target nozzle designation data 124 become "1100".

The operation of the complementary data generation block 125 will be described with reference to FIG. 4.

The complementary data generation block 125 receives the target data 123 and target nozzle designation data 124, performs logical-ORs of these data, and outputs the resultant bit string as the discharge failure-complemented data 126 to the complementary data memory. Consequently, complementary printing is performed for only a bit "1" in the bit string.

According to the above-described embodiment, data of one nozzle array is managed as 8-bit blocks. Processing operation of blocks used for printing is divided into: complementary printing for discharge failure in a head block; complementary printing for discharge failure in a tail block; and complementary printing for discharge failure in the remaining blocks. Thus, even if a discharge failure nozzle exists at the end of an area subjected to the nozzle restriction, appropriate complementary printing for discharge failure can be performed.

Even if the nozzle restriction function is adopted together, complementary processing does not execute processing targeting a nozzle which should not originally discharge ink owing to the nozzle restriction function. Proper ink discharge can be realized, and any negative effect to a printed image that conventionally occurs in the use of both the nozzle restriction function and complementary processing can be avoided. As a result, high-quality image printing can be achieved.

The above-described embodiment employs only one discharge failure nozzle setting register, but the present invention is not limited to this. For example, discharge failure nozzle setting registers corresponding to respective nozzle arrays may be arranged. Even in a printhead having a plurality of nozzle arrays as shown in FIG. 3, this invention is still applicable by switching the registers in accordance with the nozzle array for use.

In the above-described embodiment, M=15 (the number of blocks is 16), and N=127 (the number of nozzles is 128). However, the present invention is not limited to this, and can take other numerical values, e.g., M=31 (the number of blocks is 32) and N=255 (the number of nozzles is 256), or M=63 (the number of blocks is 64) and N=511 (the number of nozzles is 512). In DMA transfer, 16 bits or 32 bits may be set as a transfer unit.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Further note that in the foregoing embodiment, although the description has been provided based on an assumption that a droplet discharged by the printhead is ink and that the liquid contained in the ink tank is ink, the contents are not limited to ink. For instance, the ink tank may contain processed liquid or the like, which is discharged to a printing medium in order to improve the fixability or water repellency of the printed image or to improve the image quality.

The above-described embodiment comprises means (e.g., an electrothermal transducer or the like) for generating heat energy as energy utilized upon execution of ink discharge, and adopts the method which causes a change in state of ink by the heat energy, among the ink-jet printing methods. According to this printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called on-demand and continuous types. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

Furthermore, although each of the above-described embodiments adopts a serial-type printer which performs printing by scanning a printhead, a full-line type printer employing a printhead having a length corresponding to the width of a maximum printing medium may be adopted. For a full-line type printhead, either the arrangement which satisfies the full-line length by combining a plurality of printheads as described above or the arrangement as a single printhead obtained by forming printheads integrally can be used.

In addition, not only a cartridge type printhead in which an ink tank is integrally arranged on the printhead itself as described in the above embodiment but also an exchangeable chip type printhead which can be electrically connected to the apparatus main unit and can receive an ink from the apparatus main unit upon being mounted on the apparatus main unit can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, the printer of the present invention may be used in the form of a copying machine combined with a reader, and the like, or a facsimile apparatus having a transmission/reception function, in addition to an integrally-provided or stand-alone image output terminal of a data processing equipment such as a computer.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2003-332394 filed on Sep. 24, 2003, the entire contents of which are incorporated herein by reference.

What is claimed is:

1. A printing apparatus having a function capable of restricting use of some of a plurality of nozzles in an actual printing operation when printing is performed using an inkjet printhead having the plurality of nozzles, comprising:

first storage means for storing a position of an ink discharge failure nozzle among the plurality of nozzles;

detection means for detecting whether the position of the ink discharge failure nozzle stored in said first storage means exists at or near an end of a nozzle area which is still usable regardless of use restriction on the plurality of nozzles;

complementary printing means for performing, by using a nozzle positioned near the ink discharge failure nozzle, complementary printing in an area where printing is impossible due to the ink discharge failure nozzle; and complementary printing control means for controlling use of the nozzle for complementary printing by said complementary printing means in accordance with a detection result of said detection means, wherein the plurality of nozzles are divided into a plurality of blocks, and use of some of the plurality of nozzles is restricted for each block, and wherein said detection means detects whether the position of the ink discharge failure nozzle falls within a block corresponding to the end of the nozzle area which is still usable regardless of the use restriction on some of the plurality of nozzles.

2. The apparatus according to claim 1, further comprising second storage means for storing information which defines an area where the use of some of the plurality of nozzles is restricted.

3. The apparatus according to claim 1, wherein when the position of the ink discharge failure nozzle is detected to fall within the block corresponding to the end of the usable nozzle area, said detection means further detects whether the position of the ink discharge failure nozzle is near a boundary between the block and a block which becomes unusable owing to the use restriction on some of the plurality of nozzles.

4. The apparatus according to claim 3, wherein said complementary printing control means controls not to set, as a nozzle used for complementary printing by said complementary printing means in accordance with the detection result of said detection means, a nozzle belonging to the block which becomes unusable owing to the use restriction on some of the plurality of nozzles.

5. The apparatus according to claim 1, wherein the inkjet printhead comprises a plurality of nozzle arrays, each consisting of a plurality of nozzles, and the printing apparatus comprises a plurality of said first storage means in correspondence with the plurality of nozzle arrays.

6. The apparatus according to claim 5, further comprising switching means for switching use of said plurality of said first storage means in accordance with a nozzle array for use among the plurality of nozzle arrays.

7. The apparatus according to claim 1, wherein the inkjet printhead comprises an electrothermal transducer which generates thermal energy to be applied to ink in order to discharge ink by using thermal energy.

8. A printing method for a printing apparatus which uses an inkjet printhead with a plurality of nozzles and has a function capable of restricting use of some of the plurality of nozzles in an actual printing operation, comprising:

a storage step of storing in a register a position of an ink discharge failure nozzle among the plurality of nozzles;

a detection step of detecting whether the position of the ink discharge failure nozzle stored in the register at said storage step exists at or near an end of a nozzle area which is still usable regardless of use restriction on the plurality of nozzles;

a complementary printing step of performing, by using a nozzle positioned near the ink discharge failure nozzle, complementary printing in an area where printing is impossible due to the ink discharge failure nozzle; and a complementary printing control step of controlling use of the nozzle for complementary printing at said complementary printing step in accordance with a detection result at said detection step, wherein the plurality of nozzles are divided into a plurality of blocks, and the use of some of the plurality of nozzles is restricted for each block, and wherein said detection step detects whether the position of the ink discharge failure nozzle falls within a block corresponding to the end of the nozzle area which is still usable regardless of the use restriction on some of the plurality of nozzles.

* * * * *